US010724548B2

(12) United States Patent
Huang

(10) Patent No.: US 10,724,548 B2
(45) Date of Patent: Jul. 28, 2020

(54) COVER STRUCTURE OF A WASHER PUMP

(71) Applicant: Tsung-Chen Huang, Puxin Township, Changhua County (TW)

(72) Inventor: Tsung-Chen Huang, Puxin Township, Changhua County (TW)

( * ) Notice: Subject to any disclaimer, the term of this patent is extended or adjusted under 35 U.S.C. 154(b) by 131 days.

(21) Appl. No.: 16/020,734

(22) Filed: Jun. 27, 2018

(65) Prior Publication Data

US 2020/0003229 A1 Jan. 2, 2020

(51) Int. Cl.

*F04D 29/40* (2006.01)
*F04D 29/60* (2006.01)
*F04D 11/00* (2006.01)

(52) U.S. Cl.

CPC ..... *F04D 29/605* (2013.01); *F04D 11/00* (2013.01); *F04D 29/406* (2013.01)

(58) Field of Classification Search

CPC .... F04D 29/086; F04D 29/4206; F04D 29/44; F04D 29/605; F04D 29/708; B65D 45/345; B65D 45/34; B65D 45/24; B65D 45/28; B65D 45/16; B63B 19/24; B65F 1/1615

USPC .... 292/256, 256.5, 256.69; 29/247, DIG. 49

See application file for complete search history.

(56) References Cited

U.S. PATENT DOCUMENTS 2,551,534 A * 5/1951 Goshe ..... E05C 19/14 292/113
5,960,980 A * 10/1999 Burke ..... B61D 17/16 220/325
6,179,350 B1 * 1/2001 Ely ..... E05C 19/14 292/113
7,784,489 B2 * 8/2010 Paulin ..... F04D 9/008 137/527.2
2019/0107122 A1 * 4/2019 Shen ..... F04D 13/0673
2019/0125625 A1 * 5/2019 Huang ..... A61H 33/6021
2019/0154039 A1 * 5/2019 Wang ..... F04D 13/06

* cited by examiner

*Primary Examiner* — David E Sosnowski
*Assistant Examiner* — Sang K Kim

(57) ABSTRACT

A cover structure of a washer pump includes a base, a cover and a fastener unit assembled relative to each other. The base and the cover are fastened through the fastener unit, which facilitates the assembly and disassembly of the user. The locking member ensures that the fastener unit is in a locked state to provide a safety protection effect, which not only prevents the fastener unit from being opened by mistake, but also prevents the flow path from being too strong and causes the cover to escape the doubt of the base, thereby enhancing the The tightness of the combination of base and the cover is increased, which increases the fluency of water flow in and out, and at the same time enhances spa and massage effects.

8 Claims, 8 Drawing Sheets

A-A

COVER STRUCTURE OF A WASHER PUMP

BACKGROUND OF INVENTION

1. Field of Invention

The present invention relates to a water therapy structure, and more particularly to a cover structure of a washer pump.

2. Description of Related Art

Currently, a water spa machine generates jets of water and bubbles to soothe and relieve muscles tension. Current, nozzle cap of the spa machines utilize a screw plug structure to combine with a water supply device. Since each person's strength is different, the nozzle cap can be tighten too tight or too lose, which results different issues such as cleaning issue or lack of effect of the spa.

It is therefore desirable to provide a cover structure for a washer pump to mitigate and/or obviate the aforementioned problems.

SUMMARY OF INVENTION

An objective of present invention is to a cover structure of a washer pump that is capable of improving the above-mention problems.

In order to achieve the above mentioned objective, cover structure of a washer pump includes a base, a cover and a fastener unit assembled relative to each other. The base and the cover are fastened through the fastener unit, which facilitates the assembly and disassembly of the user. The locking member ensures that the fastener unit is in a locked state to provide a safety protection effect, which not only prevents the fastener unit from being opened by mistake, but also prevents the flow path from being too strong and causes the cover to escape the doubt of the base. Thereby, the tightness of the combination of base and the cover is improved, which increases the fluency of water flow and the spa massage effects.

Other objects, advantages, and novel features of invention will become more apparent from the following detailed description when taken in conjunction with the accompanying drawings.

DETAILED DESCRIPTION OF PREFERRED EMBODIMENT

Figure 1:
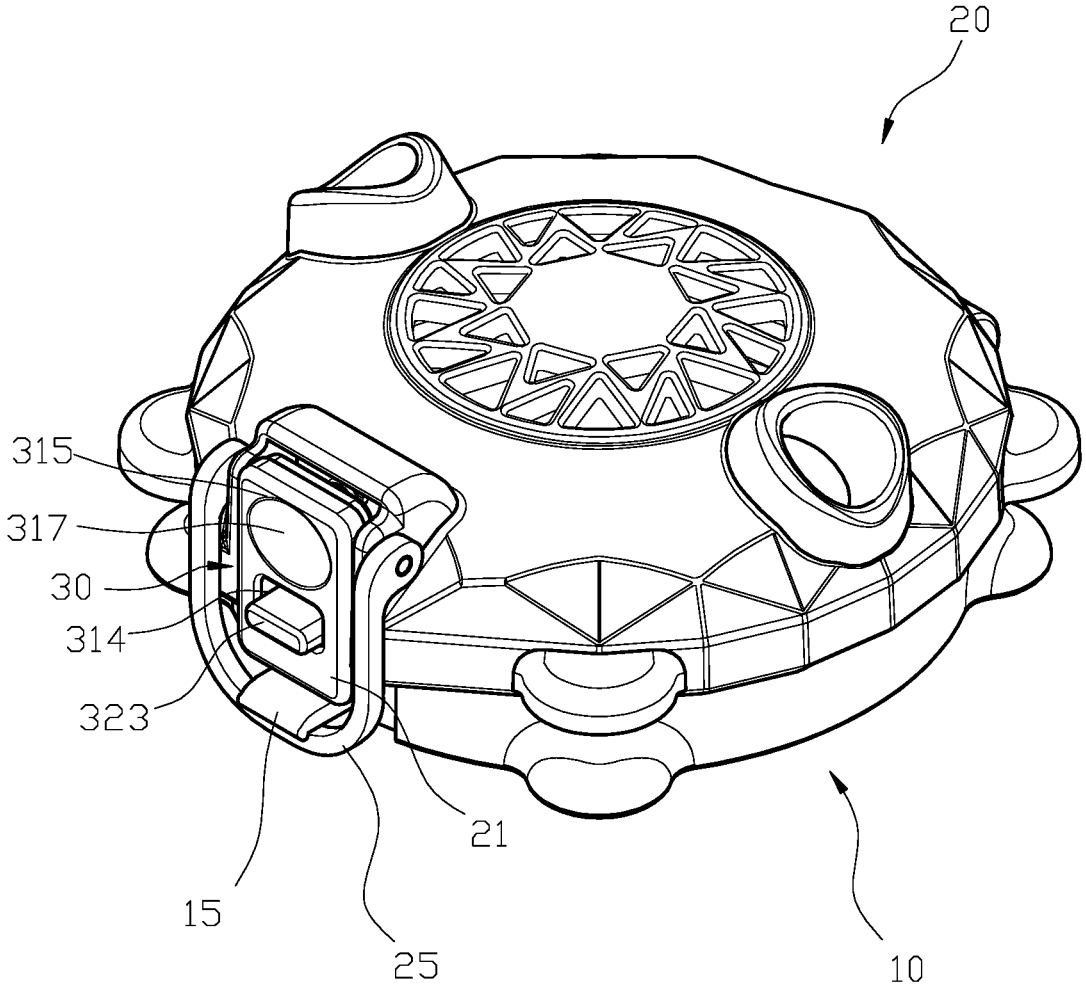
FIG. 1 is a perspective drawing of a preferred embodiment according to the present invention.
Figure 2:
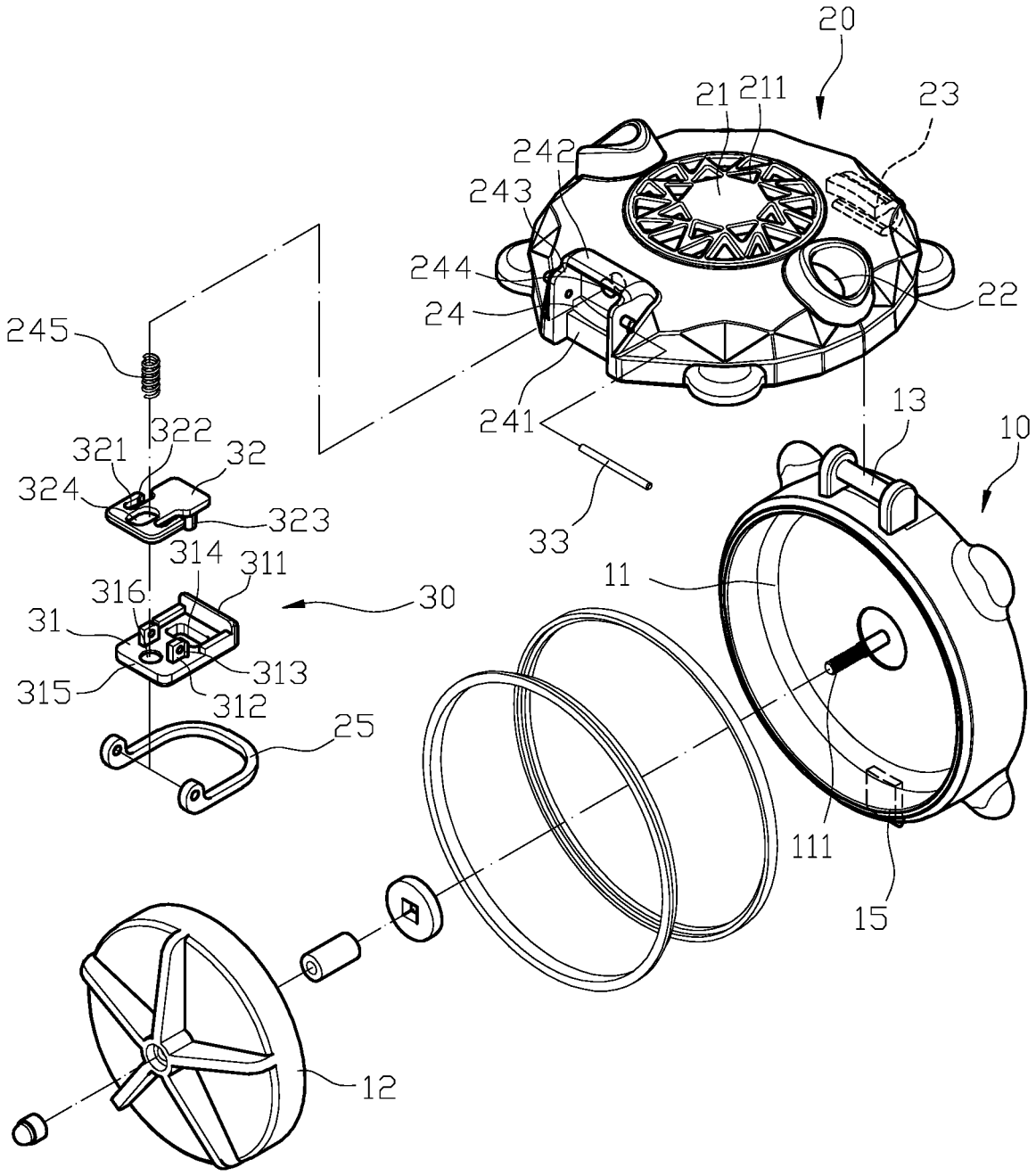
FIG. 2 is an exploded view of preferred embodiment according to the present invention.
Figure 3:
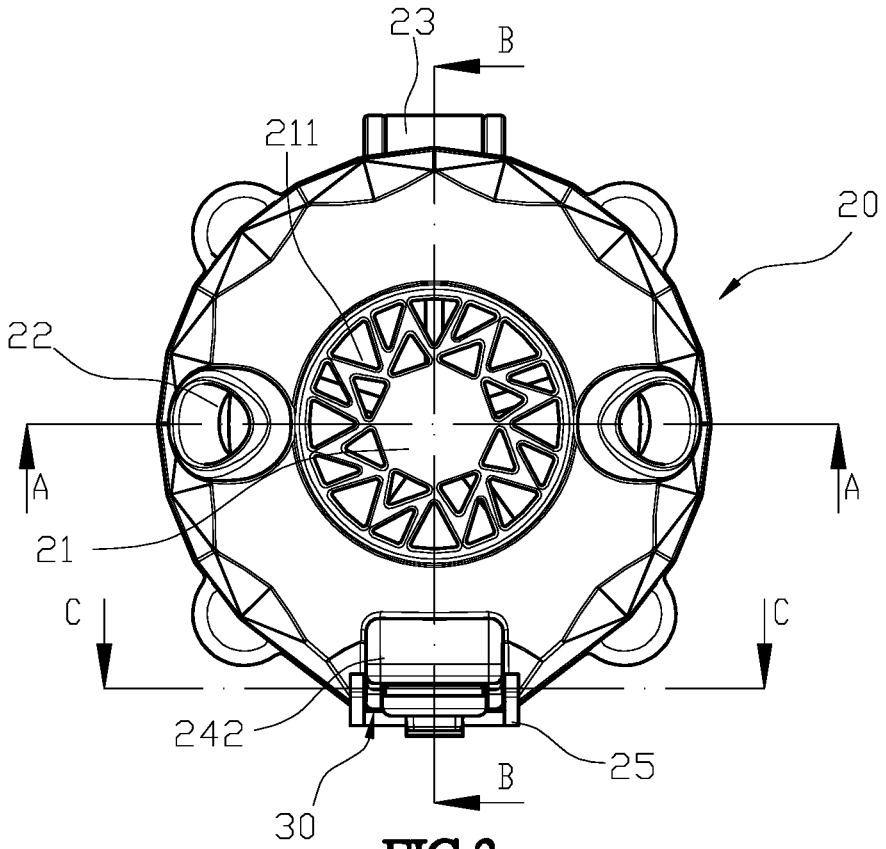
FIG. 3 is a top view of preferred embodiment according to the present invention.
Figure 4:
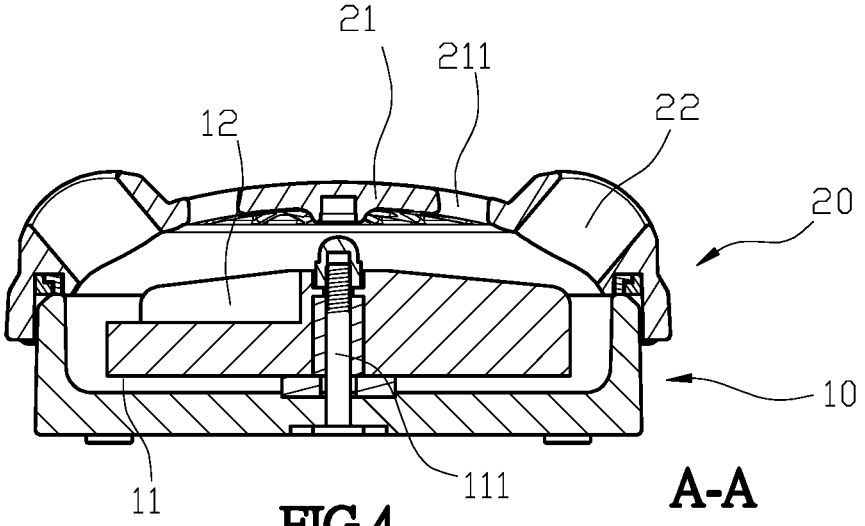
FIG. 4 is a cross-sectional drawing and a local detail schematic drawing of the FIG. 3 along a line A-A.
Figure 5:
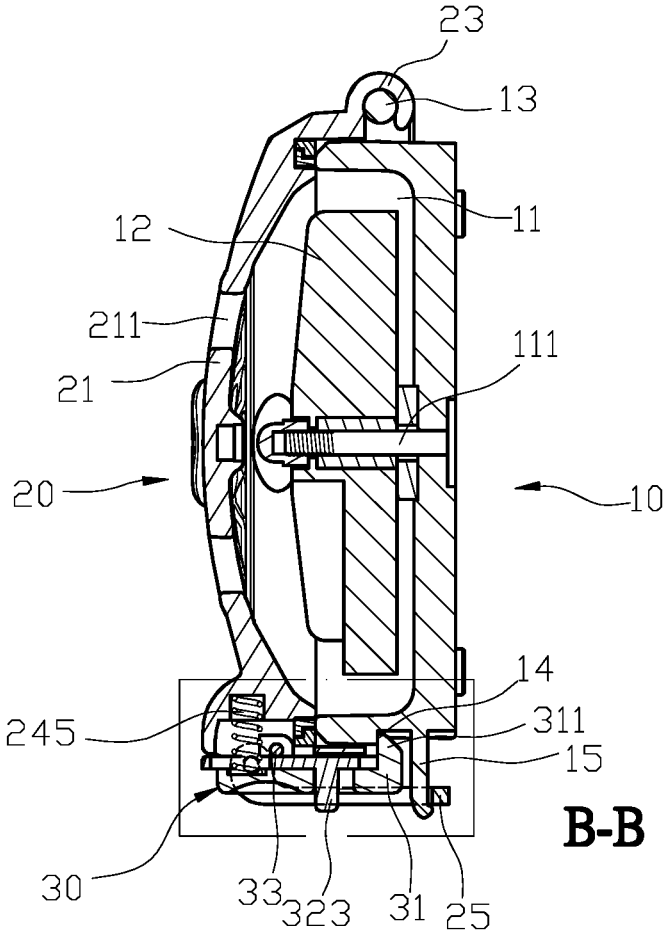
FIG. 5 is a cross-sectional drawing of the FIG. 3 along a line B-B.
Figure 6:
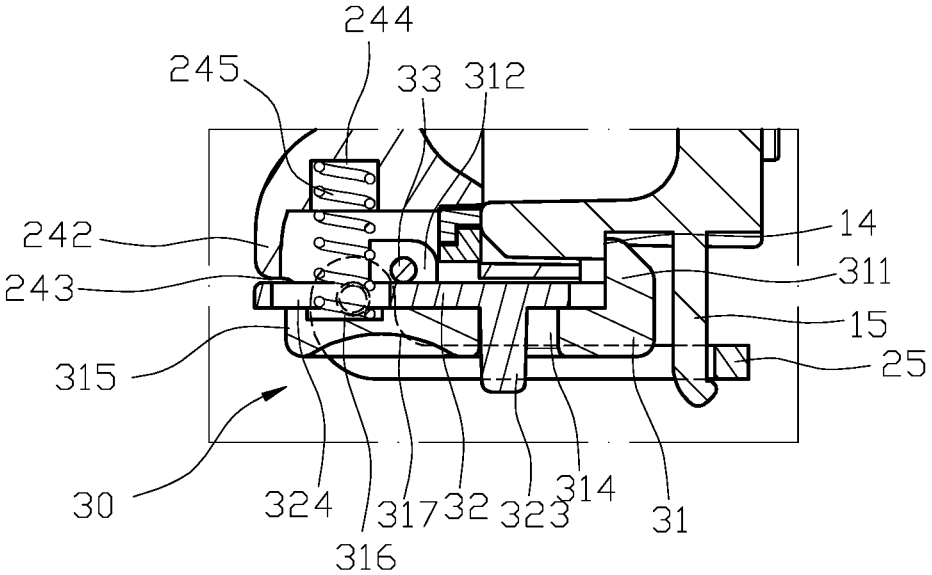
FIG. 6 is a local detail drawing of FIG. 5.

Please refer to FIGS. 1, 2 with FIGS. 3, 4, 5 and 6. A cover structure of a washer pump comprises: a base a base 10, a cover 20 and a fastener unit 30. The base 10 has a containment space 11, and the containment space 11 is provided with a driving shaft 111 configured to drive a fan 12. The cover 20 is provided with a nozzle 21 with a plurality of outlet apertures 211 and an intake aperture 22 at each side of the nozzle 21. Moreover, an end of the base 10 is provided with a pivot shaft 13, and the cover 20 further has a clip 23 engaging with the pivot shaft 13 to form a pivot portion. Another end of the cover 20 is capable of rotating around the pivot portion. The base 10 further has a fastener portion 14, and the cover 20 has an assembling slot 24 corresponding to the fastener portion 14 and for accepting the fastener unit 30. The assembling slot 24 is provided with an opening 241 facing the fastener portion 14 and a stopping sidewall 242 opposite the end having the opening 241. A through slot 243 is disposed at a bottom of the stopping sidewall 242, the fastener unit 30 has an engaging member 31 and a locking member 32 overlapping each other. The engaging member 31 utilizes a shaft 33 pivotably connected to the assembling slot 24, and the locking member 32 is limited between the assembling slot 24 and the engaging member 31. The engaging member 32 has a clip 311 engaging the fastener portion 14 of the base 10. Furthermore, the locking member 31 has two symmetric connecting blocks 312 pivoted in the assembling slot 24 respectively with a shaft 33. The two connecting blocks 312 respectively have a positioning protrusion 313 and a through aperture 314 between the two connecting blocks 312 and the clip 311. A pressing area 315 is provided on an end of the engaging member 31 facing the stopping sidewall 242, an indent aperture 316 is disposed on the pressing area 315 and facing the assembling slot 24, and the assembling slot 24 is correspondingly provided with an indent slot 244. An elastic member 245 is disposed between the indent aperture 316 and the indent slot 244, and a recess 317 is provided on the pressing area 315. The locking member 32 is capable of sliding between the assembling slot 24 and the engaging member 31 and has two limiting slots 321 correspondingly limiting the two connecting blocks 312 of the engaging member 31. A positioning indentation 322 is respectively provided at an inner side of the two limiting slots 321 and configured for engaging with the positioning protrusions 313 of the two connecting blocks 312. The locking member 32 has a trigger portion 323 penetrating through the through aperture 314 of the engaging member 31. The locking member 32 further comprises an elongate aperture 324 corresponding to the indent aperture 316 of the pressing area 315, for accepting the elastic member 245. The base 10 further comprises an engaging hook 15 adjacent to the fastener portion 14, and the cover 20 is further provided with a pivoted rotatable U hook 25 engaging with the engaging hook 15.

For structural assembly, please refer to FIGS. 2-6 and 8. The base 10 and the cover 20 are combined with the pivot shaft 13 and the clip 23 to form a pivot portion. The pivot portion is configured for the cover 20. The cover 20 utilizes the assembled slot. 24 to assemble the fastener unit 30, and the engaging member 31 and the locking member 32 of the fastener unit 30 are overlapped with each other. The two limiting slots 321 of the locking member 32 are relatively engaged with the two connecting blocks 312 of the engaging member 31. Meanwhile, the trigger portion 323 projects out of the through aperture 314 of the engaging member 31, the two connecting blocks 312 are pivoted in the assembling slot 24 of the cover 20 with a shaft 33. The elastic member 245 is provided between the indent aperture 316 of the pressing area 315 and the indent slot 244 of the assembling slot 24, and the clip member 311 of the engaging slot 31 protrudes through the opening 241 of the assembling slot 24 to reach to the assembling slot. 24. Therefore, the fastener unit 30 is normally supported by the elastic member 245 to push against the pressing area 315, and the clip 311 fastens the fastener portion 14 of the cover 20 for secure, then the trigger portion 323 of the locking member 32 is pushed to move toward the stopping sidewall 242. Afterward, the locking member 32 is placed through the through slot 243 of the stopping sidewall 242, so the pressing area 31 of the engaging member 31 is stopped and cannot be pressed down which forms a locking state of the fastener unit 30. Furthermore, the U hook 25 rotates toward the base 10 to engage with the engagement hook 15, the cover 20 is positively and tightly fastened to the base 10, and the fan 12 is limited in the containment space 11 to complete a cover structure for the washer pump.

Figure 7:
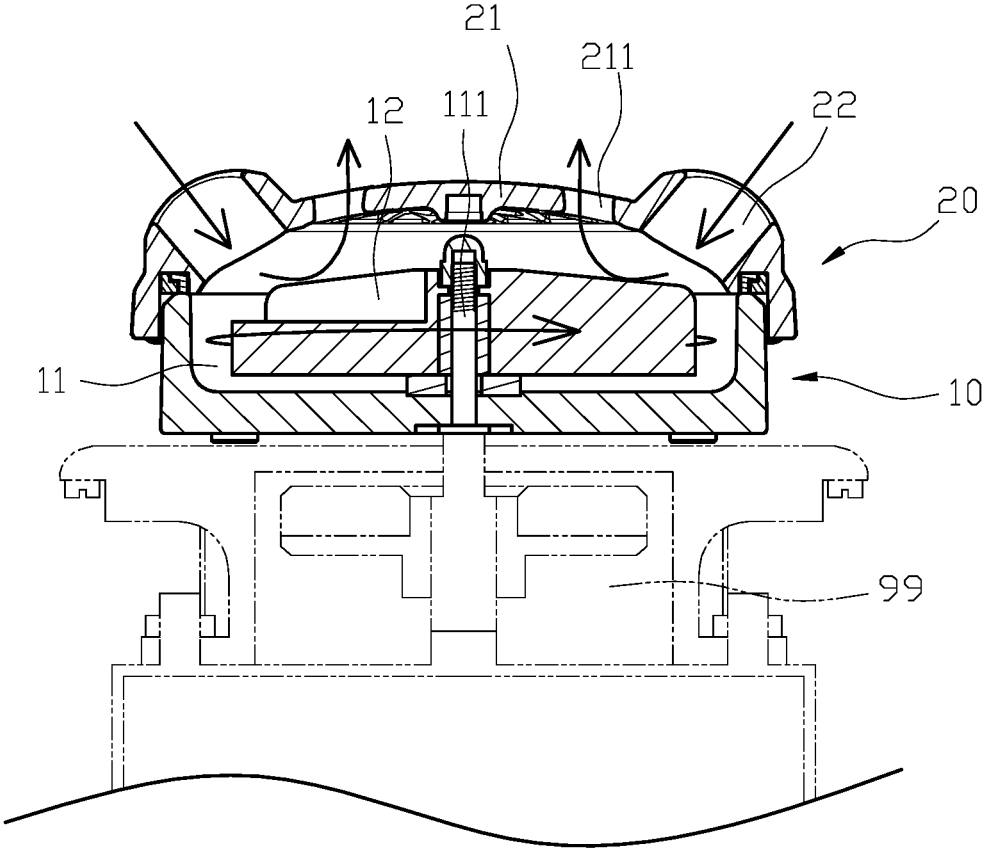
FIG. 7 is a schematic drawing of actual operation of the preferred embodiment according to the present invention.

For actual operation, please refer to FIG. 7. The base 10 utilizes a driving motor 40 to rotate the driving shaft 111 to drive the fan 12, and the fan 12 generates a swirl due to a centrifugal force to move water from the two intake apertures 22 of the cover 20 into the containment space 11, then the water forms a stream at the center of the fan and leaves from the nozzle 21 to exit the outlet apertures 211 with air bubbles which can be therapeutical.

Figure 8:
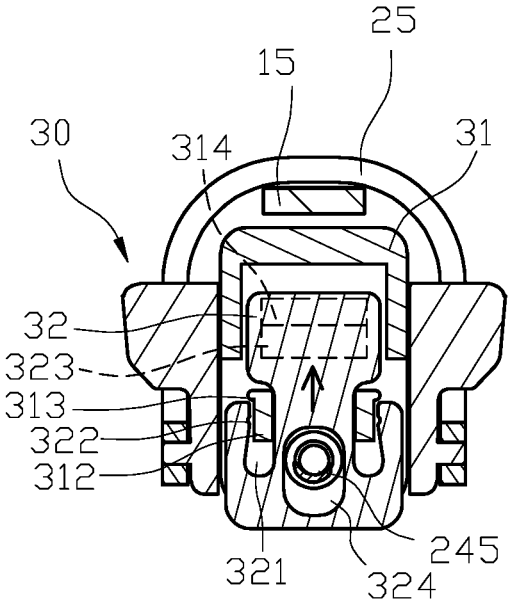
FIG. 8 is a cross-sectional drawing of the FIG. 3 along a line C-C.
Figure 9:
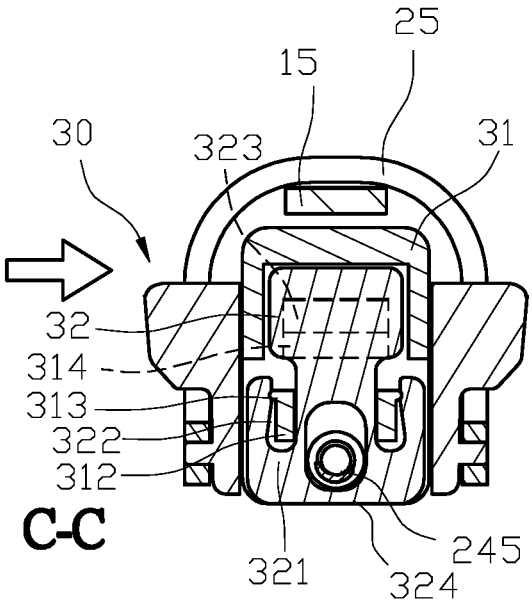
FIG. 9 is a cross-sectional drawing of the FIG. 3 along a line C-C showing the unlocking status.
Figure 10:
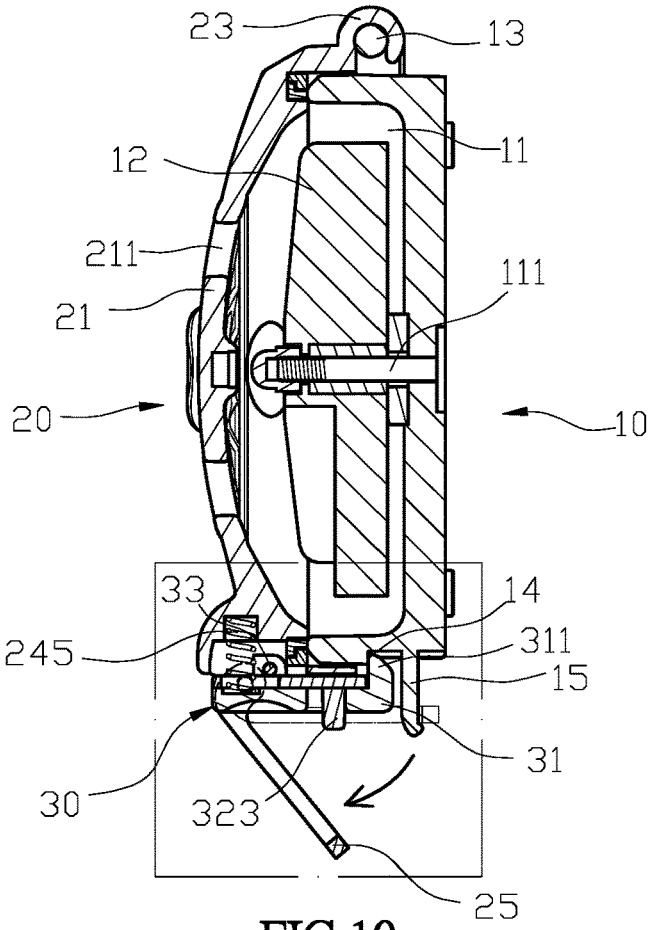
FIG. 10 shows the U hook being release according to the present invention.
Figure 11:
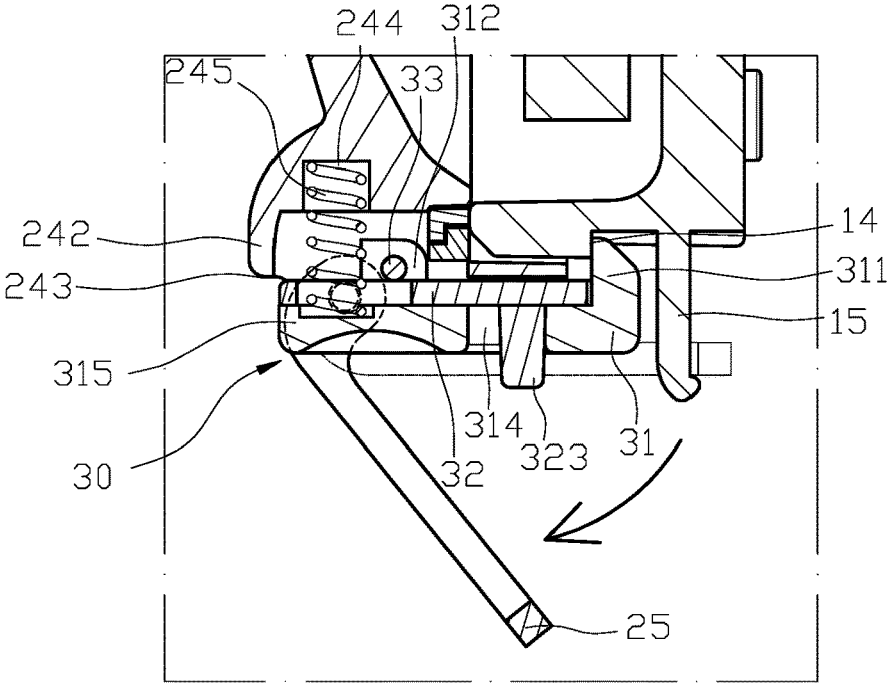
FIG. 11 is a local detail drawing of FIG. 10
Figure 12:
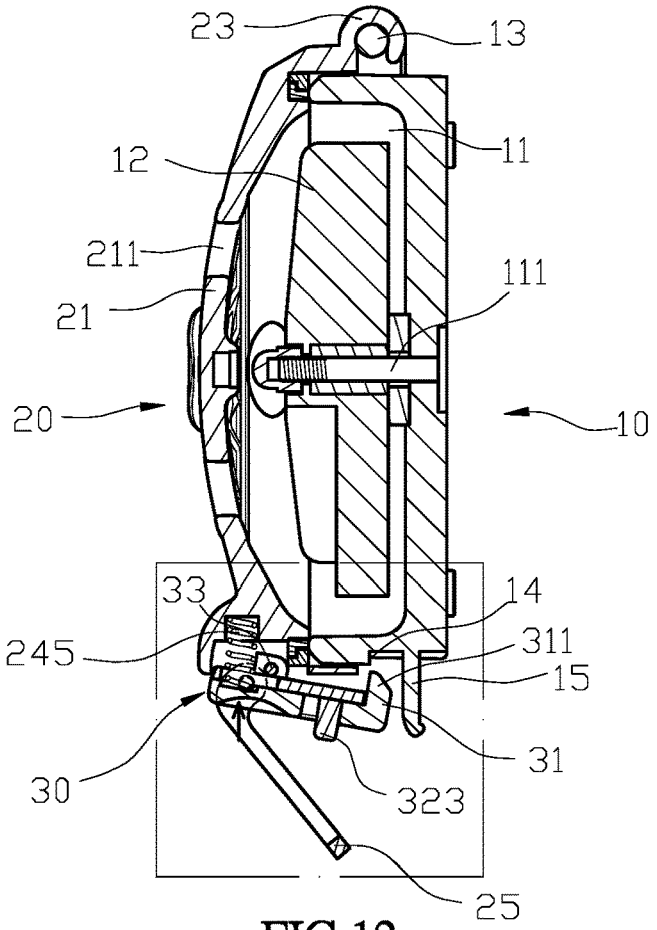
FIG. 12 shows the fastener unit moving away from the fastener portion according to the present invention.
Figure 13:
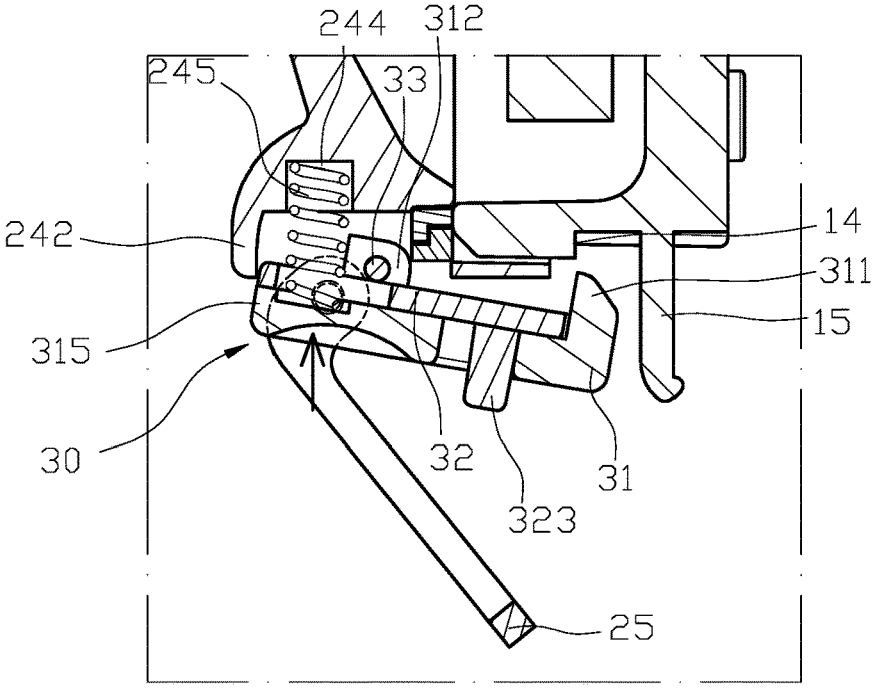
FIG. 13 is a local detail drawing showing the fastener unit moving away from the fastener portion according to the present invention.
Figure 14:
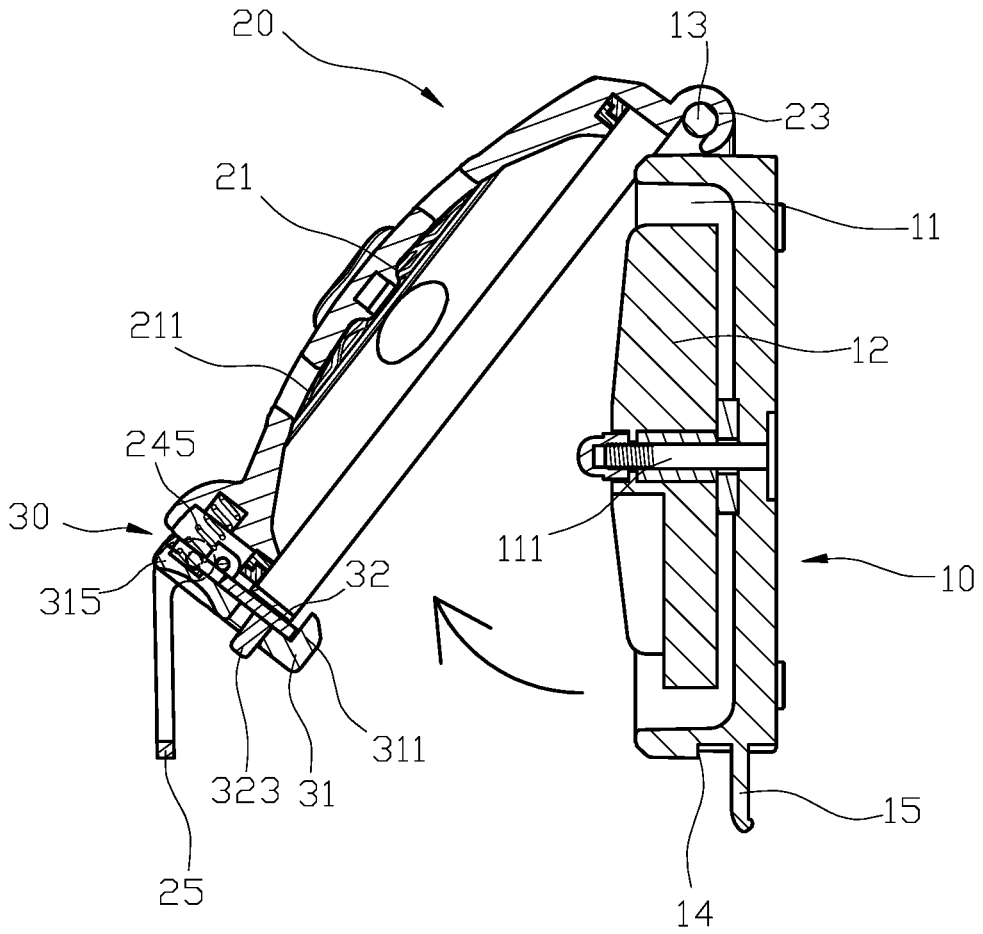
FIG. 14 shows the cover being removed from the base according the present invention.

Moreover, in order to clean or maintain the cover 20, please refer to FIGS. 8 and 9 with FIGS. 10-14. Firstly, the U hook 25 is reversed to disengage with the hook 15, then the fastener member 32 of the fastener unit 30 is pushed toward the opening direction 241 of the assembling slot 24 so that the end of the locking member 32 is retracted into the assembling slot 24 and leveled with the engaging member 31. Meanwhile, the positioning indentation 322 of the two limiting slots 321 and the positioning protrusion 313 of the three connecting block 312 are engaged to release the locking state. Afterward, the pressing area 315 of the engaging member 31 is pressed inwardly to make the clip 311 to rotate around the shaft 33 to release from the fastener portion 14. Therefore, the cover 20 can be opened away from the base 10. When the pressing area 315 of the engaging member 31 is released, the clip 311 is sunk cause of the injection of the elastic member 245. And, when the cover 20 is closed toward the base 10, the clip 311 is directly secured with the fastener portion portion 14 for easy assembly.

With the structure in the above-mentioned embodiment, the following benefits can be obtained: the base 10 and the cover 20 are fastened together through the fastener unit 30, which facilitates the assembly and disassembly for the user, and the locking mechanism 32 ensures the fastener unit 30 forming a locked state for safety and protection effect. That not only prevents the fastener unit 30 from being opened by mistake, but also prevents the water flow impact force from being too strong to cause the cover 20 to escape from the base 20. The tightness between the combination of 10 and the cover 20 is increased, which improves the fluency of the water flow and the spa massage effects.

Although the present invention has been explained in relation to its preferred embodiment, it is to be understood that many other possible modifications and variations can be made without departing from the spirit and scope of invention as hereinafter claimed.

What is claimed is:

1. A cover structure of a washer pump comprising:

a base, and a cover, wherein:

the base and a first end of the cover are combined with a pivot portion, another end of the cover capable of rotating around the pivot portion and having a fastener unit;

the base has a fastener portion, the cover having an assembling slot for correspondingly accepting the fastener portion;

the assembling slot is provided with an opening facing the fastener portion, and a stopping sidewall opposite the the opening;

a through slot is disposed at a bottom of the stopping sidewall;

the fastener unit has an engaging member and a locking member overlapping each other;

the engaging member utilizes a shaft pivotably connected to the assembling slot, the locking member being limited between the assembling slot and the engaging member, the engaging member having a clip engaging the fastener portion of the base; and the locking member is capable of moving between the assembling slot and the engaging member and has a trigger portion penetrating through the engaging member.

2. The cover structure of a washer pump as claimed in claim 1, wherein the base has a containment space, and the containment space comprises a driving shaft configured to drive a fan.

3. The cover structure of a washer pump as claimed in claim 2, wherein the base further includes a driving motor for driving the driving shaft.

4. The cover structure of a washer pump as claimed in claim 1, wherein the cover comprises:

a nozzle, and intake apertures on opposite sides of the nozzle.

5. The cover structure of a washer pump as claimed in claim 4, wherein the nozzle of the cover is further comprises a plurality of outlet apertures.

6. The cover structure of a washer pump as claimed in claim 1, wherein:

the engaging member has two symmetric connecting blocks pivoted with the assembling slot respectively with the shaft;

the two connecting blocks respectively have a positioning protrusion, and a through aperture is disposed between the two connecting blocks and the clip for accepting the trigger portion of the locking member;

a pressing area is provided on an end of the engaging member facing the stopping sidewall, an indent aperture is disposed on the pressing area and facing the assembling slot, and the assembling slot is correspondingly provided with an indent slot; and an elastic member is disposed between the indent aperture and the indent slot, and a recess is provided on the pressing area.

7. The cover structure of a washer pump as claimed in claim 6 wherein the locking member has two limiting slots correspondingly limiting the two connecting blocks of the engaging member, a positioning indentation respectively provided at an inner side of the two limiting slots and configured for engaging with the positioning protrusions of the two connecting blocks, and the locking member further comprises an elongate aperture corresponding to the indent aperture of the pressing area, for accepting the elastic member.

8. The cover structure of a washer pump as claimed in claim 1, wherein the base further comprises an engaging hook adjacent to the fastener portion, and the cover is further provided with a pivoted rotatable U hook engaging with the engaging hook.

* * * * *